US008881738B2

(12) United States Patent
Bryman

(10) Patent No.: US 8,881,738 B2
(45) **Date of Patent: *Nov. 11, 2014**

(54) INTEGRATED SMOKING DEVICE

(76) Inventor: Gary Bryman, Mar Vista, CA (US)

( * ) Notice: Subject to any disclaimer, the term of this patent is extended or adjusted under 35 U.S.C. 154(b) by 915 days.

This patent is subject to a terminal disclaimer.

(21) Appl. No.: 13/046,129

(22) Filed: Mar. 11, 2011

(65) Prior Publication Data

US 2011/0162663 A1 Jul. 7, 2011

Related U.S. Application Data

(63) Continuation-in-part of application No. 11/260,018, filed on Oct. 26, 2005, now Pat. No. 7,753,055.

(51) Int. Cl.

| | |
|---|---|
| ***A24F 13/00*** | (2006.01) |
| ***A24F 17/00*** | (2006.01) |
| ***A24F 25/00*** | (2006.01) |
| ***A24D 1/10*** | (2006.01) |
| ***A24F 1/10*** | (2006.01) |
| ***A24F 9/10*** | (2006.01) |
| ***A24F 3/00*** | (2006.01) |
| ***A24F 47/00*** | (2006.01) |
| ***A24F 11/00*** | (2006.01) |
| ***A24F 5/04*** | (2006.01) |
| ***A24F 1/02*** | (2006.01) |
| ***A24F 13/04*** | (2006.01) |

(52) U.S. Cl.
CPC ..... *A24F 3/00* (2013.01)
USPC ..... 131/329; 131/351; 131/330; 131/184.2; 131/185; 131/328; 131/198.2; 131/215.1; 131/223

(58) Field of Classification Search
USPC ..... 131/351, 330, 184.2, 185, 329, 328, 131/198.2, 215.1, 223
See application file for complete search history.

(56) References Cited

U.S. PATENT DOCUMENTS

| | | | | |
|---|---|---|---|---|
| 3,422,821 | A * | 1/1969 | Calkins | 131/195 |
| 6,196,232 | B1 * | 3/2001 | Chkadua | 131/222 |
| 2004/0187879 | A1 * | 9/2004 | Iordan | 131/194 |

* cited by examiner

*Primary Examiner* — Richard Crispino
*Assistant Examiner* — Matthew Hoover
(74) *Attorney, Agent, or Firm* — J. Curtis Edmondson; Law Offices of J. Curtis Edmondson

(57) ABSTRACT

A smoking device having an integrated lighter, a bowl for holding an igniteable vegetable product, and a duct for drawing smoke like a pipe. The device consists of an ignition switch located on the side of the pipe in natural proximity to the thumb, a piezo-electric ignition system, a flammable gas delivery system, a bowl for holding smoking material, and an aperature for drawing the smoke emitted from the ignited vegetable product.

8 Claims, 7 Drawing Sheets

INTEGRATED SMOKING DEVICE

CROSS REFERENCE TO RELATED APPLICATIONS

This application is a Continuation-In-Part and claims priority to and the benefit of U.S. patent application Ser. No. 11/260,018 filed Oct. 26, 2005, and issued as U.S. Pat. No. 7,753,055 on Jul. 13, 2010, entitled "INTEGRATED SMOKING DEVICE"; and claims priority to and the benefit of U.S. patent application Ser. No. 11/875,793 filed on Oct. 17, 2007, entitled "INTEGRATED SMOKING DEVICE" the entire disclosure of which is hereby incorporated by reference as if set forth in its entirety for all purposes.

BACKGROUND

The present inventive subject matter relates to a device for smoking. More specifically, the present inventive subject matter relates to an apparatus and a method for smoking with a single integrated device.

Smoking pipes are well known in the arts. A typical pipe consists of cylindrical bowl with a rounded depression for holding shredded or granulated vegetable matter (hereinafter "smoking material"). The base of the bowl has a small hole that is connected to a tube. The user of the smoking pipe breathes air in through the tube, which draws air through the smoking material. The user of the smoking pipe ignites the smoking material while drawing air through the tube. The smoke from the ignited material is then drawn into the lungs of the user via the tube during the inhalation process.

The process of smoking typically involves two separate devices. There is a pipe that holds the smoking material and an ignition device. The impracticality of the two devices is that sometimes the user will forget one of the devices. The common phrase, "Do you have a light?", albeit serving the purpose of social interaction, does not alleviate the problem of looking for a lost matchbook or a lighter.

In addition, the bowl for holding smoking material is impractical for long-term storage. Pipes with open bowls may be easily upset, dispersing smoking material unexpectedly. In addition, exposure to air lessens the freshness and flavor of smoking material. This necessitates the use of a separate sealed pouch with restricted air flow to store smoking material. These pouches are often large and not easily transported in a shirt or pants pocket. The time required to load smoking material presents a barrier to instant gratification of the urge to smoke.

Further, smoking devices may be brittle or have irregular shapes or sizes, making it difficult for a user to transport. Some pipes may be made of brittle materials unsuitable for transportation in a handbag or include extensions that may be broken off. Irregular shapes or large size make storage in a shirt or pants pocket impractical.

Finally, smoking devices typically need to be operated with two hands: one hand holding a pipe containing smoking material and another hand holding a lighter. This requires the user to put down any object such as a cell phone they may be carrying. With the ubiquitous use of cell phones in modern times, this may be significant hardship.

Relevant prior art includes devices, such as clay, corn cob, and briar pipes as well as water pipes or hookahs. These prior art devices lack both an integrated igniter and the ability to easily store and transport smoking material.

SUMMARY

The present inventive subject matter provides an integrated smoking device that includes a bowl for holding smoking material, an ignition source, a fuel source directing fuel at the bowl, and a chamber to carry smoke to the user. Some embodiments may include a housing or a cover over the bowl. Some embodiments introduce the flame within the bowl. Other embodiments position the flame above the bowl. The integrated smoking device may be of the approximate dimensions to be held in the palm of an adult's hand.

One embodiment includes a housing made of metal a bowl formed from a depression in the housing. This bowl holds the smoking material. A slidable cover is positioned over the bowl and can be moved to cover the bowl or retracted into the housing. An aperture within the bowl is connected to a chamber to carry smoke to the user. When not in use, the device is roughly the shape of a rectangular prism with the chamber to carry smoke extending beyond the generally rectangular shape. A movable arm includes an ignition source, an aperture to emit fuel, and a tube to transport fuel. The movable arm lies flat in line with the housing when the device is not in use and swings to position the flame over the bowl when the device is in use. A user control located on the side of the housing controls the movable arm, initiates the flow of fuel, and triggers the igniter. A flame adjustment allows the maximum fuel flow when the user control is depressed to be increased or decreased.

A typical use of this embodiment consists of the user placing an amount of smoking material into the bowl in advance. When the user desires to smoke, the user opens the retractable cover and activates the user control. This initiates the flow of fuel, triggers the igniter to ignite the fuel, and causes the movable arm to swing up, directing the flame at the bowl in a single operation. When the user draws from the chamber, the flame is deflected downwards, igniting the smoking material. As the smoking material burns, the user draws smoke through the chamber, via his or her mouth.

In a different embodiment, a hand-sized integrated smoking device includes a bowl with a retractable cover for smoking material. The device is roughly the shape of a rectangular prism. Within the bowl there are three apertures. The first aperture provides a spark source, the second aperture provides a source of fuel, and the third aperture connects to a chamber to carry smoke to the user. The user is able to breathe in the smoke from the chamber through a hole. There is a wire to transport the piezoelectric impulse, a tube to transport the source of fuel, and chamber to carry smoke to the user. The device is activated by a user control on the side of the housing which both initiates the fuel flow and triggers the piezoelectric striker.

These and other embodiments are described in more detail in the following detailed descriptions and the figures.

The foregoing is not intended to be an exhaustive list of embodiments and features of the present inventive subject matter. Persons skilled in the art are capable of appreciating other embodiments and features from the following detailed description in conjunction with the drawings.

DETAILED DESCRIPTION

While describing the inventive subject matter and its embodiments, various terms will be used for the sake of clarity. These terms are intended to not only include the recited embodiments but also all equivalents that perform substantially the same function, in substantially the same manner, to achieve the same result.

Figure 1:
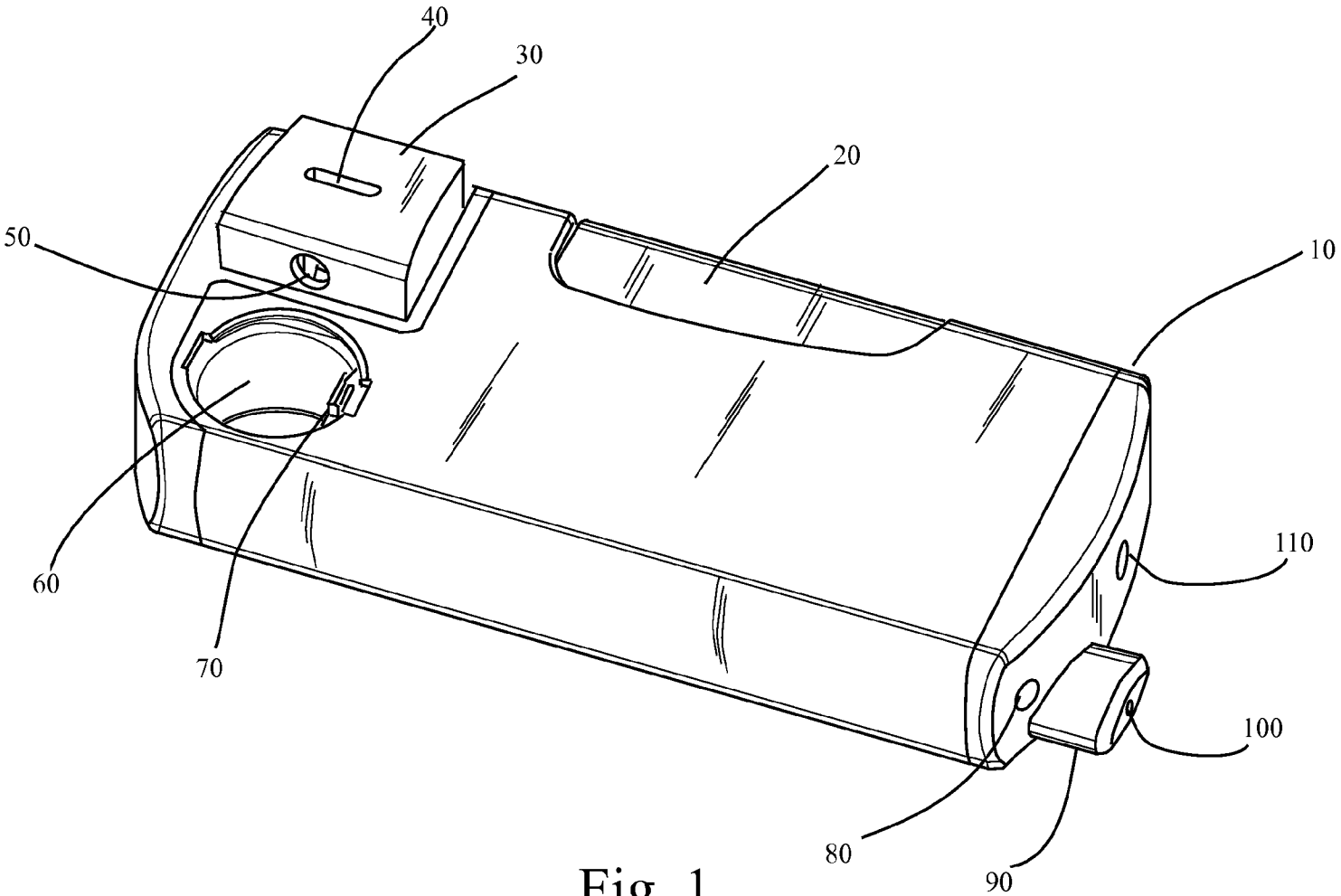
FIG. 1 is an isometric top exterior view of one embodiment of the integrated smoking device with a bowl depicting the movable arm in the active position and the bowl uncovered.

One embodiment of the integrated smoking device with a movable arm that rotates and an off-center bowl is shown in FIGS. 1-7. FIG. 1 illustrates an isometric view of the device 10. This embodiment includes a housing to which components may be attached. The shape of this embodiment is generally that of a rectangular prism with a small projection beyond a rectangular shape for the smoke tube housing 90 and the draw end 100. While the faces are generally planar, they incorporate slight curvature for a pleasing design. These measurements of this embodiment are approximately 3⅜ inches by ½ inch by 1½ inches.

The device 10 includes user control 20. User control 20 causes the rotatable arm 30 to rotate into the active position as shown. Rotatable arm 30 includes a flame assembly 50 and an air intake aperture 40. The bowl 60 is located off-center relative to the left and right sides of the device and includes a slidable cover 70 shown in the open position. The smoke chamber is a tube in this embodiment. The smoke tube housing 90 extends beyond the end face of the device 10 to enclose the draw end 100. The smoke tube (not shown) extends from draw end 100 to the bowl 60. A removable screen (not shown) may be used to separate the tube from the bowl. One function of the screen is to deter burning smoking material from entering the smoke tube.

The flame assembly 50 is shown positioned so that fuel is directed at the bowl 60. In this embodiment, when the fuel is ignited, the flame projects above the bowl when the user does not draw air through draw end 100. If smoking material is packed entirely within the bowl, the flame may not ignite the smoking material. If smoking material projects out of the bowl, the flame may ignite the smoking material when the user does not draw air through draw end 100. One advantage of projecting the flame above the smoking material is to allow unburned fuel to dissipate in the open air. When the user draws air through draw end 100, the flame may be deflected to contact the smoking material.

The smoke tube and the bowl are fluidly coupled to allow gases and particles to flow between them. When the user creates vacuum pressure at draw end 100, air and smoke are drawn through the smoke tube (not shown) from the bowl 60. Flame adjustment 80 allows variation in the maximum flow of fuel when the user control is engaged to increase or decrease the maximum size of the flame.

Insertion or removal of screw 110 allows for assembly or disassembly of the exterior shell casing. Removal of the screw allows the exterior shell to be pulled back and the inner contents revealed.

Figure 2:
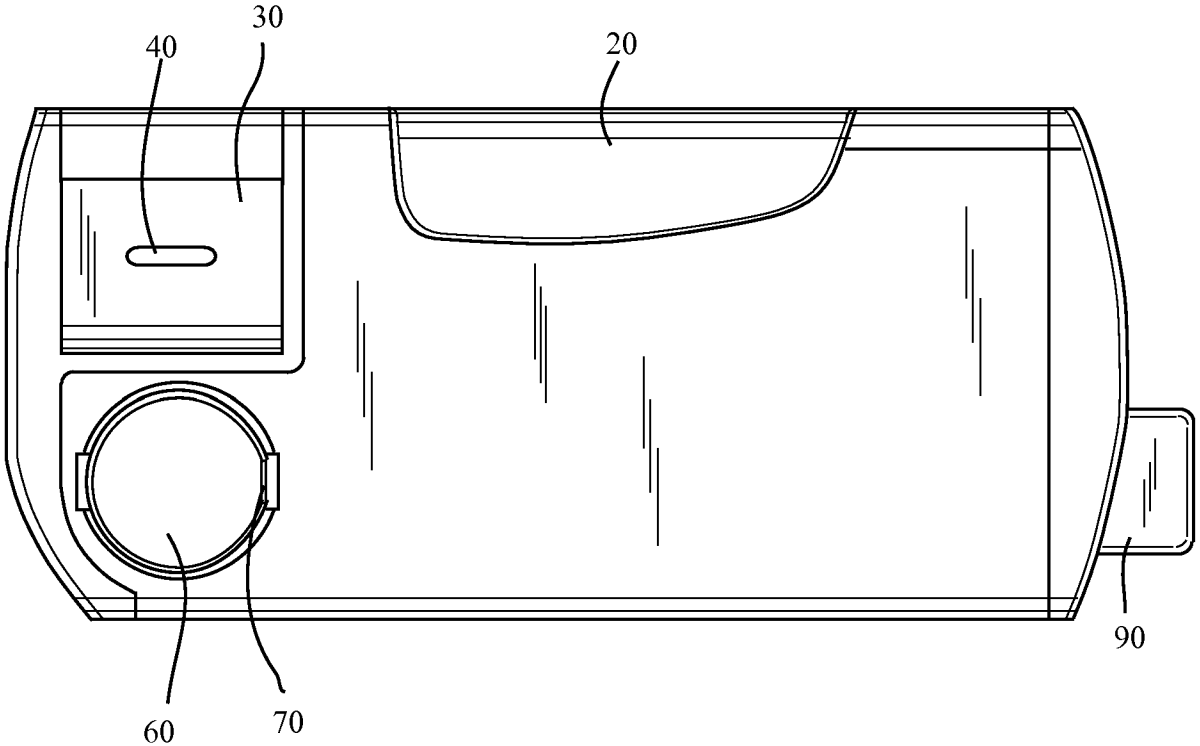
FIG. 2 is a top exterior view of one embodiment of the integrated smoking device with the bowl fully exposed and the movable arm in the active position.

FIG. 2 is a top exterior view showing user control 20, rotatable arm 30 in the active position, air intake aperture 40, bowl 60, and smoke tube housing 90. Cover 70 is depicted in the open configuration.

Figure 3:
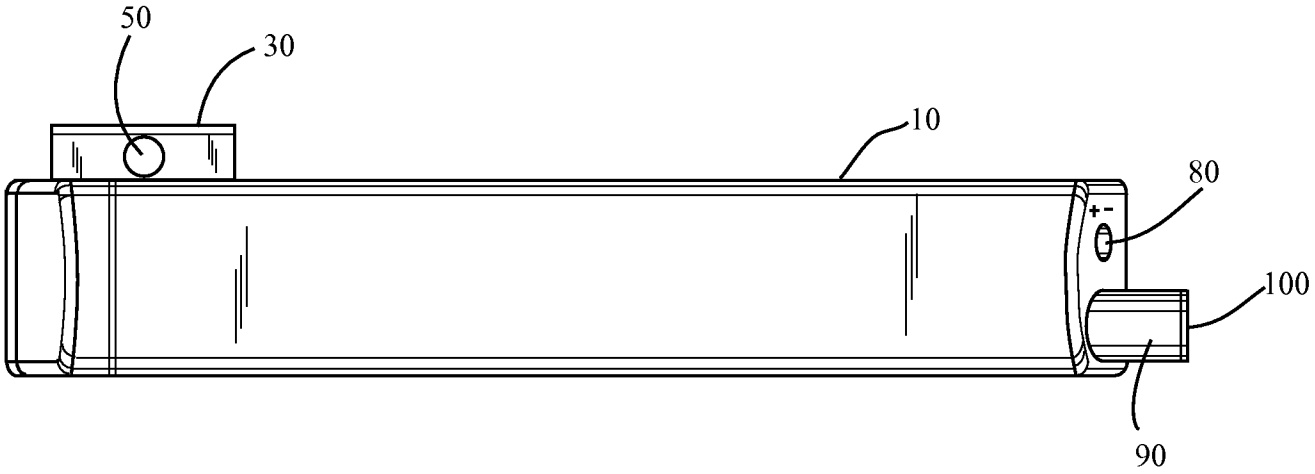
FIG. 3 is a side exterior view of one embodiment of the integrated smoking device with the movable arm in the active position.

FIG. 3 is a side exterior view of device 10 showing rotatable arm 30 in the active position. The figure also depicts flame assembly 50, smoke tube housing 90, and draw end 100. Flame adjustment 80 is visible because of a slight curvature in the end face.

Figure 4:
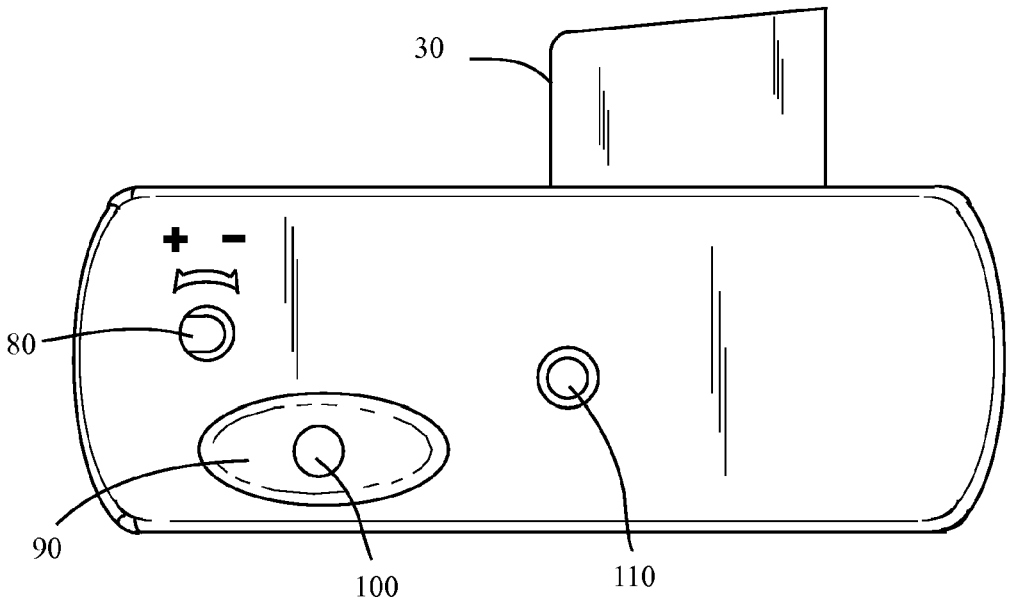
FIG. 4 is an exterior end view of one embodiment of the integrated smoking device with the flame adjustment and smoke chamber visible and the movable arm in the active position.

FIG. 4 is an exterior end showing rotatable arm 30 in the active position. Flame adjustment 80, smoke tube housing 90, draw end 100, and screw 110 are also shown.

Figure 5:
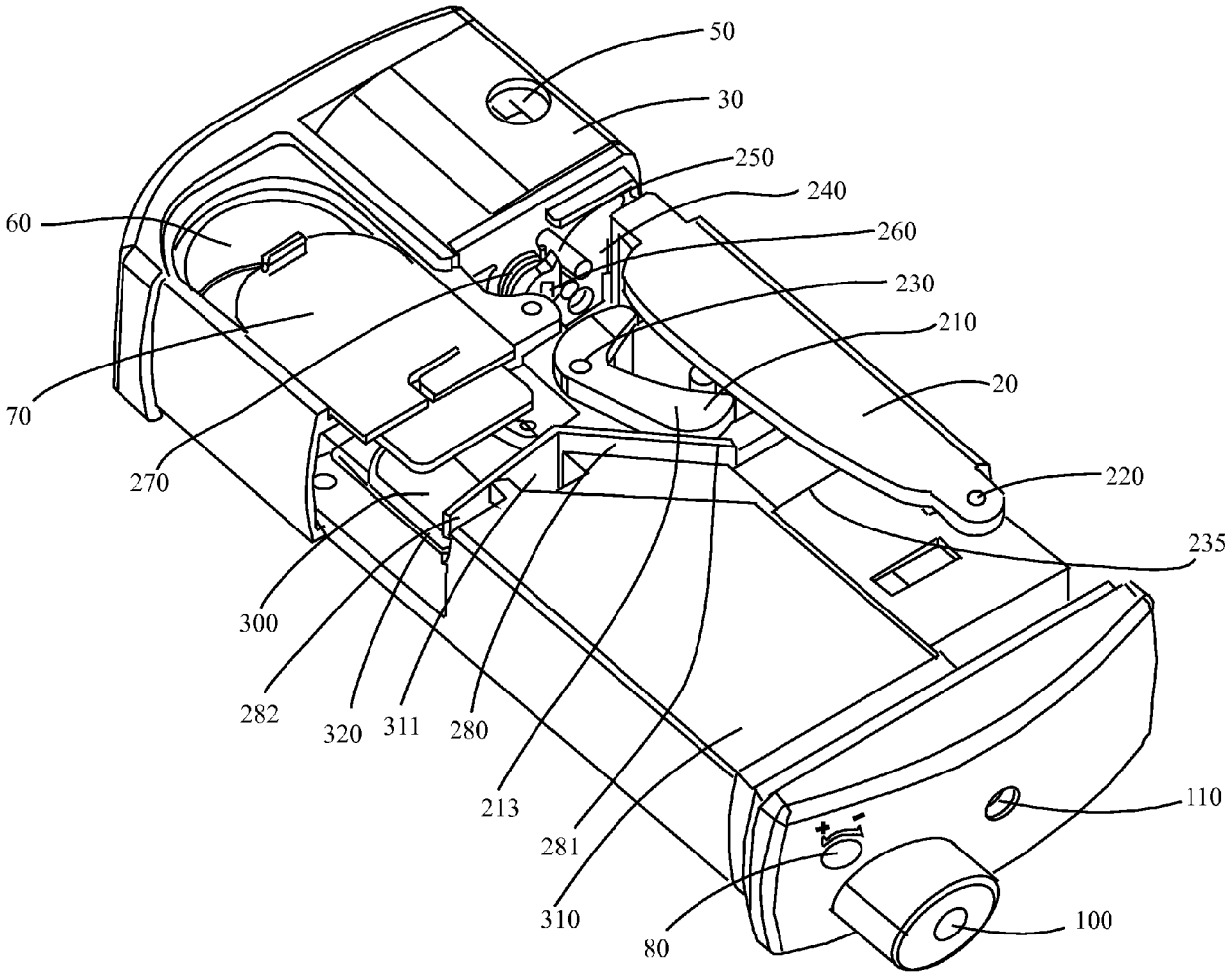
FIG. 5 is a top isometric view of one embodiment depicting internal components with the bowl partially exposed and the movable arm in the inactive position.

FIG. 5 is an isometric view depicting internal components. Cover 70 is held slidably in a depression allowing it to slide back and forth between a closed and open position. In the closed position, cover 70 completely covers bowl 60. In the open position, cover 70 retracts within the housing so bowl 60 is uncovered. The position shown is partway between open and closed positions.

User control 20 is rotatably engaged to user control pivot 220. When depressed, user control 20 causes a number of actions including rotatable arm 30 to rotate into active position, fuel to flow, and the fuel to ignite.

Activation of user control 20 causes rotatable arm 30 to rotate as follows. When user control 20 is activated, user control far edge 240 of user control 20 contacts and communicates pressure to stop 250. Rotatable arm pivot 260 is connected to both rotatable arm 30 and the housing and allows rotatable arm 30 to rotate. Stop 250 is rigidly connected to rotatable arm 30. Pressure on stop 250 communicated from user control far edge 240 causes rotatable arm 30 to rotate in a counter-clockwise direction around pivot 260. Thus, rotatable arm 30 is rotatably coupled to the housing. Spring 270 provides a restoring force, resisting pressure on stop 250 from user control far edge 240 and returning rotatable arm 30 to the inactive position when user control 20 is released.

Operating user control 20 opens the fuel flow as follows. When activated, the user control 20 is activated, user control near edge 21 of user control 20 contacts and communicates pressure to the rocker arm near edge 211 of rocker arm 210. Rocker arm 210 may rotate around fixed point rocker arm pivot 230. When rocker arm 210 rotates clockwise, rocker arm opposite edge 213 contacts and communicates force to strip near edge 281. Reservoir pivot finger 311 extends from reservoir 310. Pressure on strip near edge 281 causes strip 280 to pivot about reservoir pivot finger 311, causing strip far edge 282 to open fuel valve 315 (not shown), enabling fuel flow. When fuel value 315 is open, fuel is allowed to flow from reservoir 310 through fuel feed tube 320.

Activation of user control 20 also causes ignition by spark as follows. When rocker arm 210 rotates clockwise, rocker arm 210 also contacts and communicates pressure to piezoelectric striker 235. Piezoelectric striker 235 is electrically connected to flame assembly 50, in this case by a wire (not shown). Piezoelectric striker 235 builds pressure to a release point, then applies force suddenly to an internal piezoelectric element which provides an electrical impulse. The electrical impulse is carried to flame assembly 50, causing a spark.

In this embodiment, the novel design of user control 20 allows three functions to be performed on activation: rotating rotatable arm 30 into the active position, allowing fuel to flow, and causing the fuel to ignite. Combination of these three operations allows one-hand operation of the device.

Figure 6:
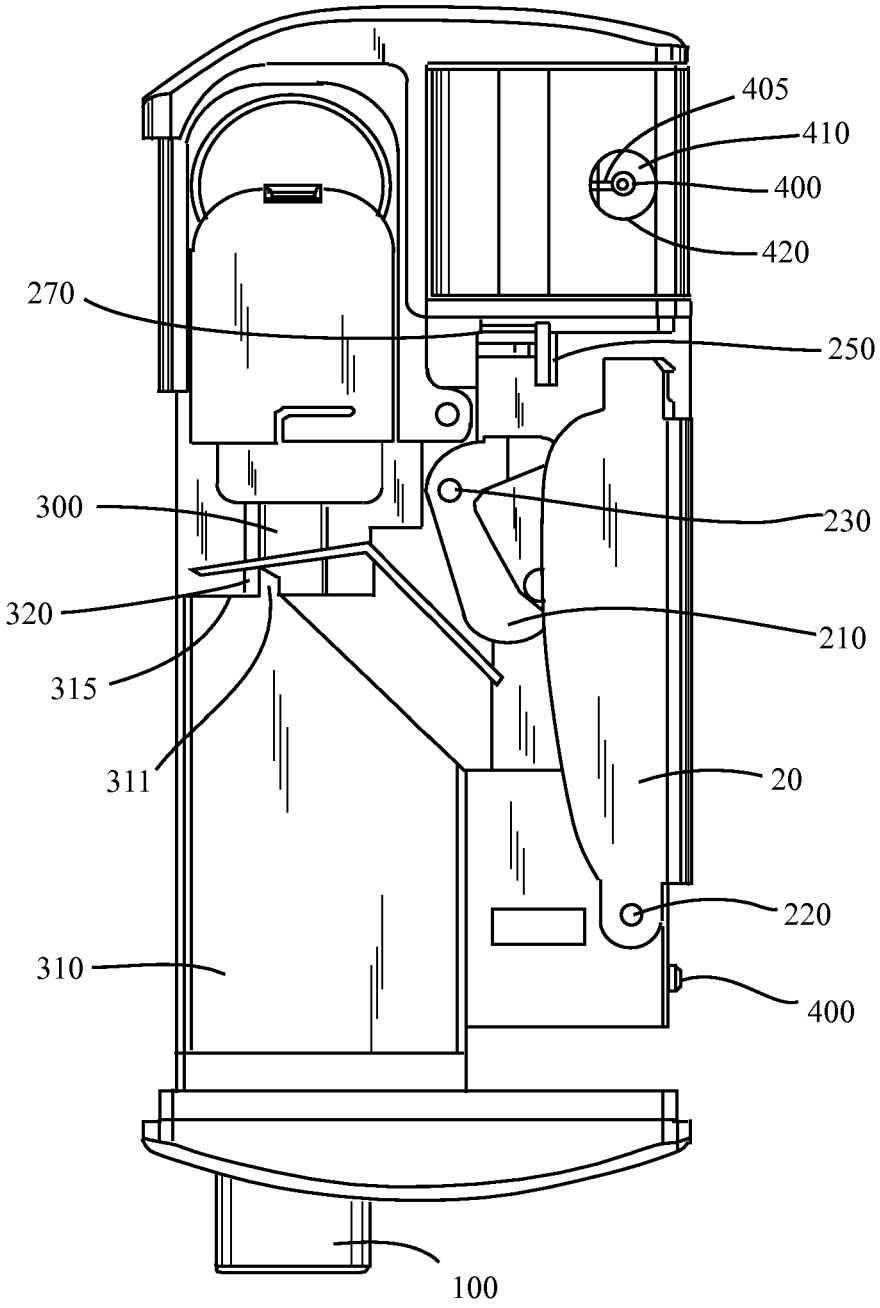
FIG. 6 is a top view of one embodiment depicting internal components with the bowl partially exposed and the movable arm in the inactive position.

FIG. 6 shows additional detail. Flame assembly 50 comprises fuel aperture 400, igniter 405, empty space 410, spark gap 415, and flame aperture 420. Fuel feed tube 320 connects fuel valve 315 to fuel aperture 400. Igniter wire (not shown) conducts an electrical impulse from piezoelectric striker 235 to igniter 405 causing a spark across spark gap 415 between igniter wire and flame aperture 420. When fuel is flowing from fuel aperture 400, a spark from igniter 405 will ignite the fuel causing flame to emerge from flame aperture 420.

When rotatable arm 30 is in the active position, flame is emitted from flame aperture 420 directed at the bowl 60. When the user inhales, air and smoke are drawn from bowl 60 through smoke tube 300 to draw end 100. Fuel feed tube 320 connects reservoir 310 to fuel aperture 400 and allows fuel to flow when fuel valve 315 is open. Refill inlet 430 allows fuel to be inserted into reservoir 310.

Figure 7:
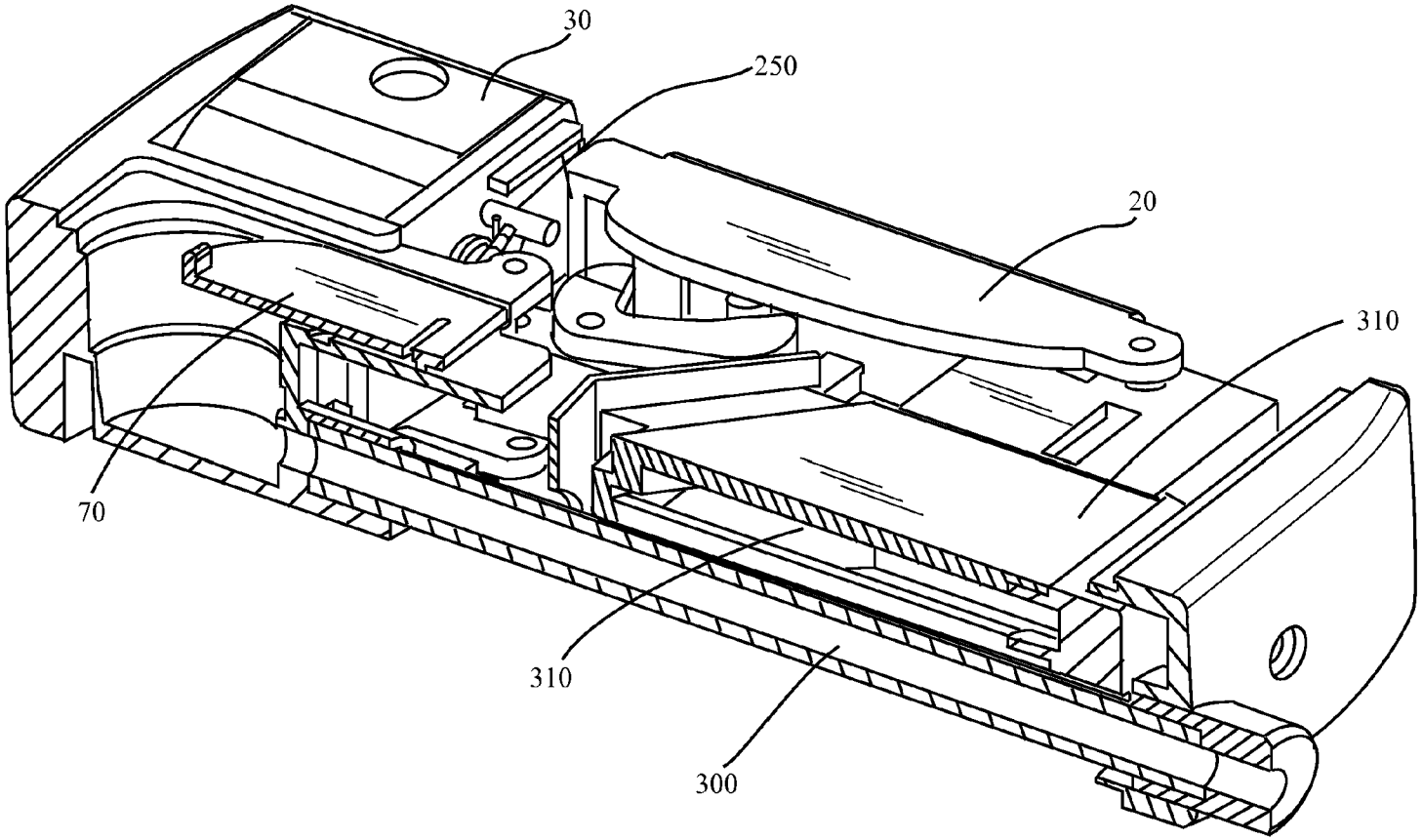
FIG. 7 is an isometric top view of one embodiment depicting internal components with the bowl partially exposed and the movable arm in the inactive position.

FIG. 7 shows a cutaway view depicting a cross-section of smoke tube 300. Rotatable arm 30 is shown in the inactive position. Cover 70 is shown halfway between open and closed position. Also depicted are user control 20, stop 250, and reservoir 310.

As used herein, "fuel" refers to any combustible material liquid, solid, gel, or gas including butane, alcohol, and naphtha. It may be comprised of a mixture of flammable materials. It may include additives to accelerate, retard, or equalize combustion rate or temperature. It may be selected to provide compact storage, heat output, desired flammability or inflammability, and safety.

As used herein, "tube" refers to any method suitable for transporting the intended material. Tubes may be constructed from any materials that satisfy their design requirements, for example, the tube that connects the fuel source to the bowl may not be degrade when in contact with the fuel. Tubes may be round, square, or any other shape in cross section and may be rigid or flexible. A tube may consist of a void in internal components rather than a discrete component. A tube may also include a screen at one end, the other end, or somewhere in the middle or a screen may be used outside the tube. A screen may be used with a smoke tube to prevent burning smoking material from entering the smoke tube.

As used herein, "igniter" refers to any method of igniting fuel including a spark. The igniter may work through discharge of a electrical impulse generated in piezoelectric, electric, chemical, or mechanical manner, contact of materials such as flint and steel, a pilot light, compression, or thermal heating. The igniter may make use of a battery.

As used herein, "directed at the bowl" refers to any method which positions the flame to ignite the smoking material. This includes positioning the flame near the bowl, directing the flame into the bowl, or creating a flame within the smoking material. This includes positioning the flame near the bowl in such a way that the flame does not contact the smoking material unless air is drawn, deflecting the flame.

As used herein, "user control" refers to any structure or mechanism allowing the user to effect device behavior. It may be a two-position switch with on and off positions, a continuous switch allowing variable positioning continuously anywhere within a range of positions, or some combination of the two. A user control may control one or more functions in a single operation. A user control may activate fuel flow and fuel ignition in a single action. A user control may activate fuel flow, fuel ignition, and movable arm motion in a single action. A user control may activate fuel flow, fuel ignition, and uncovering of the bowl. A user control may activate fuel flow, fuel ignition, movable arm motion, and uncovering the bowl. A user control may be specially adapted for left-handed or right-handed use or for equal ease of use with either hand.

As used herein, "gaseous flow" between two points refers to the significant likelihood that gases and floating particles could flow between those two points without dispersing in intervening air. It does not require absolute containment of the gases or floating particles. Mere proximity is often sufficient. Enabling gaseous flow for the smoke tube includes positioning the smoke tube close to smoking material, within the bowl, above the bowl, and any position where significant amounts of smoke may be drawn by the user. Gaseous flow may include a screen to restrict large particles or solids.

The bowl may be formed from a depression in the housing or a separate component attached to the housing. Smoking material may be placed entirely in the bowl or may project above the bowl.

A cover for the bowl may or may not be included. The cover may be attached or detachable, slidable, hinged, or using some other method of operation. The cover may be composed of metal, plastic, rubber, silicone, or some other material or combination of materials that may significantly or totally restrict smoking materials, air, or both through a contact or proximity with the bowl. The cover may be adapted to keep out air, preserving the freshness of the smoking material. The cover may be adapted to retain small particles of smoking material in the bowl. The cover may include a mechanism such a latch to hold the cover in one or more position.

The device may produce sensory input of some kind in addition to normal operation of the device. This sensory input may be visual. The visual stimulus may be either colored or white. The visual stimulus may be illuminate the flame, bowl, or smoking material. The source of the visual stimulus may be incorporated into the bowl, movable arm, user control, or external body of the device if present in the particular embodiment. The source of the visual stimulus may be powered by piezoelectric source or by battery and may operate on ignition or during use.

The sensory input may be auditory. The auditory stimulus may include sounds or music produced by a sound-emitting device. The auditory stimulus may be generated when the user control is initially operated or continuously as long as the user control is depressed. The sound-emitting device may use any known technology for producing sound including but not limited to piezoelectric and magnetic, static and dynamic.

The exterior of the device may be of suitable construction consisting of either metal or plastic such as to satisfy certain durability, cost, and recycling objectives. The exterior of the device may be electro-plated, painted, chemically or laser etched. The exterior of the device may be personalized using a design, artwork, or graphic or the name or initials of the user.

Likewise, internal components may be constructed of various materials to satisfy the requirements of the device. For example, the bowl may be constructed of a ceramic or glass to prevent the imparting of a metallic taste to the smoke upon ignition. The bowl may be centered or positioned off center from the main axis of the device.

The shape of the device may be roughly the shape of a rectangular prism, roughly the shape of a rectangular prism with a short portion of the smoke tube extending, roughly the shape of a rectangular prism with the user device extending, or some other shape.

The device may be designed to make left or right-handed use easier, may be designed to be operated with equal ease by either hand alone or be designed for two-handed use.

A refill mechanism may be included or the device may be disposable. In either case, the lighter may be composed of materials selected for their ability to be recycled.

The device may include additional reservoirs of the same or different fuel. The device may also include additional reservoirs to hold various smoking materials.

The device may include a flame adjustment to allow user control of the maximum fuel flow when the device is in use.

Persons skilled in the art will recognize that many modifications and variations are possible in the details, materials, and arrangements of the parts and actions which have been described and illustrated in order to explain the nature of this inventive concept and that such modifications and variations do not depart from the spirit and scope of the teachings and claims contained therein.

The invention claimed is:

1. An integrated smoking device comprising:

a housing;

a bowl disposed in the housing;

a smoke tube coupled to the bowl at a bowl end allowing gaseous flow from the bowl end to a draw end;

a flame assembly associated with a fuel aperture for directing fuel for a flame near the bowl and approximately parallel to the bowl;

an igniter arranged near the fuel aperture so that when the fuel aperture is directing fuel, the igniter ignites the fuel; and a moveable arm, said moveable arm externally and proximately mounted near the bowl, the moveable arm further comprising the flame assembly and an air intake aperture;

wherein said moveable arm has an active position and an inactive position, wherein said moveable arm is thrust above the housing in the active position and is lowered towards the housing in the inactive position; and wherein said flame assembly further comprises said fuel aperture and said igniter;

a user control arranged such that a user may activate the igniter and cause fuel to flow from the fuel aperture, so as to produce a flame directed at the bowl, in a single operation.

2. The integrated smoking device of claim 1 wherein the igniter is triggered by an electrical impulse from a piezoelectric striker.

3. The integrated smoking device of claim 1 wherein at least one of the fuel aperture and the igniter are disposed in the moveable arm having at least an active position where a flame is directed at the bowl and an inactive position where a flame is not directed at the bowl.

4. The integrated smoking device of claim 3 wherein the moveable arm moves linearly from the active position to the inactive position.

5. The integrated smoking device of claim 3 wherein the moveable arm rotates from the active position to the inactive position.

6. The integrated smoking device of claim 3 wherein the bowl is integrated within the housing.

7. The integrated smoking device of claim 6 wherein the bowl is integrated between two generally parallel, elongated planar surfaces of the housing.

8. The integrated smoking device of claim 3 wherein the bowl is fabricated from glass.

* * * * *

UNITED STATES PATENT AND TRADEMARK OFFICE

CERTIFICATE OF CORRECTION

PATENT NO. : 8,881,738 B2
APPLICATION NO. : 13/046129
DATED : November 11, 2014
INVENTOR(S) : Gary Bryman It is certified that error appears in the above-identified patent and that said Letters Patent is hereby corrected as shown below:

On the title page item (57),

Line 2: igniteable needs to be replaced with ignitable.

Line 7: aperature needs to be replaced with aperture.

Signed and Sealed this
Seventeenth Day of February, 2015

Michelle K. Lee

Michelle K. Lee
*Deputy Director of the United States Patent and Trademark Office*